US005238498A

United States Patent [19]

Bang et al.

[11] Patent Number: 5,238,498

[45] Date of Patent: Aug. 24, 1993

[54] OPEN TUBE-TYPE IMPURITY-DIFFUSION APPARATUS FOR SIMULTANEOUSLY DIFFUSING IMPURITIES INTO A PLURALITY OF WAFERS SUBJECTED TO A COMMON ENVIRONMENT, FOR PRODUCING A MASS OF SEMICONDUCTOR CHIPS

[75] Inventors: Dong-Soo Bang, Seoul; Jun-Young Kim, Suweon, both of Rep. of Korea

[73] Assignee: SamSung Electronics Co., Ltd., Suweon, Rep. of Korea

[21] Appl. No.: 733,180

[22] Filed: Jul. 19, 1991

[30] Foreign Application Priority Data

Feb. 18, 1991 [KR] Rep. of Korea ..... 91-2571

[51] Int. Cl.[5] ..... C23C 16/00

[52] U.S. Cl. ..... 118/719; 118/725

[58] Field of Search ..... 118/725, 719

[56] References Cited

U.S. PATENT DOCUMENTS 3,632,429 1/1972 Maeda ..... 118/725

3,705,567 12/1972 Emels ..... 118/725

OTHER PUBLICATIONS

Wolf, Silicon Processing for the VLSI Era, vol. I ©1986, Lattice Press, Sunset Beach, Calif. pp. 264–267.

Ohishi et al., "Open-Tube Zn Diffusion Method for InGaAsP/InP Heterojunction Bipolar Transistors", *Japanese Journal of Applied Physics*, vol. 2, No. 2, Feb. 1990, pp. L213–L216.

*Primary Examiner*—Richard Bueker

*Attorney, Agent, or Firm*—Cushman, Darby & Cushman

[57] ABSTRACT

An open-tube type impurity diffusion apparatus for simultaneously diffusing impurities into a plurality of wafers in a same controlled environment. The apparatus includes a diffusion box including a diffusion source, a diffusion box for holding a plurality of wafers, a slider including a body having a perforated portion and non-perforated portion and heaters disposed in a furnace. Because the apparatus can be used to simultaneously diffuse impurities into a plurality of wafers once, a mass of semiconductors can be produced, production cost and time can be decreased, and deviation of the wafer characteristics from wafer to wafer within a batch can be minimized.

3 Claims, 3 Drawing Sheets

OPEN TUBE-TYPE IMPURITY-DIFFUSION APPARATUS FOR SIMULTANEOUSLY DIFFUSING IMPURITIES INTO A PLURALITY OF WAFERS SUBJECTED TO A COMMON ENVIRONMENT, FOR PRODUCING A MASS OF SEMICONDUCTOR CHIPS

BACKGROUND OF THE INVENTION

1. Field of the Invention

The present invention relates to a semiconductor wafer impurity diffusion apparatus, and more particularly to an open tube-type impurity diffusion apparatus apparatus for simultaneously diffusing an impurity over a plurality of semiconductor wafers which are all being exposed in common to the same set of environmental conditions.

2. Description of the Prior Art

In general, an open tube-type impurity diffusion apparatus for diffusing impurities over a semiconductor wafer includes a diffusion box which is mainly made of graphite and is shown in FIGS. 2A, 2B and 2C. In FIGS. 2A, 2B and 2C, a wafer 3 is shown horizontally placed in a slider 4 located on a plate 6, which is covered with wafer cover. The wafer is covered with the wafer cover at the stage depicted in FIG. 2, in order to prevent degradation of a surface of the wafer due to an atomic secession from the surface of the wafer under a diffusion process of high temperature.

A diffusion source for diffusing the wafer is taken in a diffusion box 1 located on the slider 4. Then, the slider sets a temperature of the furnace, in which a heater 5 is built, to a required diffusion temperature.

After the required temperature setting, the slider 4 is pushed to the arrow as shown in FIG. 2A so that the wafer 3 may be placed within the diffusion box 1, which includes the diffusion source as shown in FIG. 2B. Therefore, the impurities of the diffusion source activated due to the heaters 5 are diffused into the wafer.

After a predetermined time, the slider 4 is pulled to the arrow as shown in FIG. 2C and thereby the wafer 3 is removed from the diffusion box 1. Therefore, the diffusion process is terminated.

However, as this conventional impurity diffusion apparatus cannot diffuse into more than one wafer at a time, the conventional apparatus and process are employed for a research development. Also, as the apparatus can not diffuse a plurality of wafers in a same environment, mass production is difficult and stability of diffusion characteristics for each wafer cannot be obtained due to insufficient diffusion depth, and diffusion concentration.

SUMMARY OF THE INVENTION

Therefore, the present invention was made in order to solve the above-mentioned problems.

An object of the present invention is to provide an open tube-type type impurity diffusion apparatus for simultaneously diffusing a plurality of wafers a same environment to fabricate a mass of semiconductor wafer.

Another object of the present invention is to provide an open tube-type impurity diffusion apparatus for minimizing deviation of a wafer characteristics.

To achieve the above objects, according to the present inventon, an open tube-type impurity diffusion apparatus for simultaneously diffusing a plurality of wafers in a same environment comprises a diffusion box 11 including a diffusion source 21, a box 81 for loading a plurality of wafers 31, a slider 41 including a perforated body portion, and heaters 51 and 52 disposed in a furnace.

BRIEF DESCRIPTION OF THE INVENTION

The above objects and features of the present invention will be apparent from the following description of the preferred embodiment with reference to the accompanying drawning, in which.

DESCRIPTION OF THE PREFERRED EMBODIMENTS

An embodiment of of the open tube-type impurity diffusion apparatus is now described with reference to FIGS. 1A, 1B and 1C.

Figure 1A:
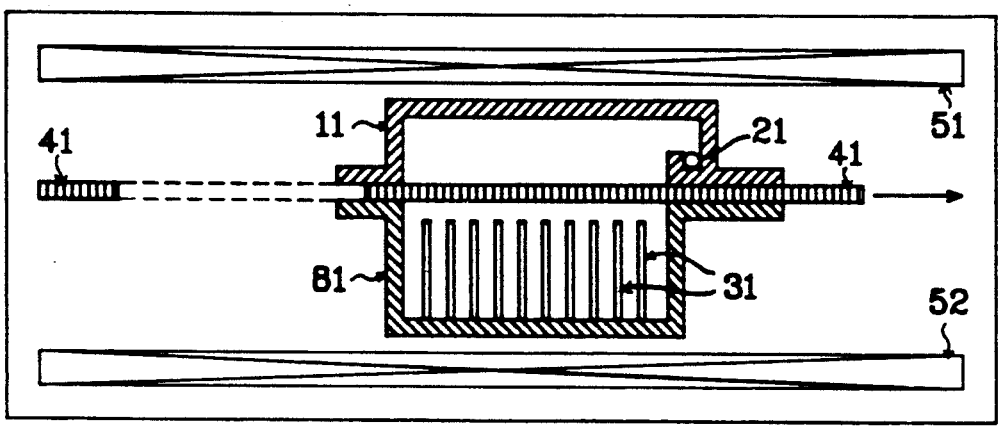
FIGS. 1A, 1B and 1C are is a sectional schematic views showing an open tube-type impurity diffusion apparatus according to the present invention.
Figure 1B:
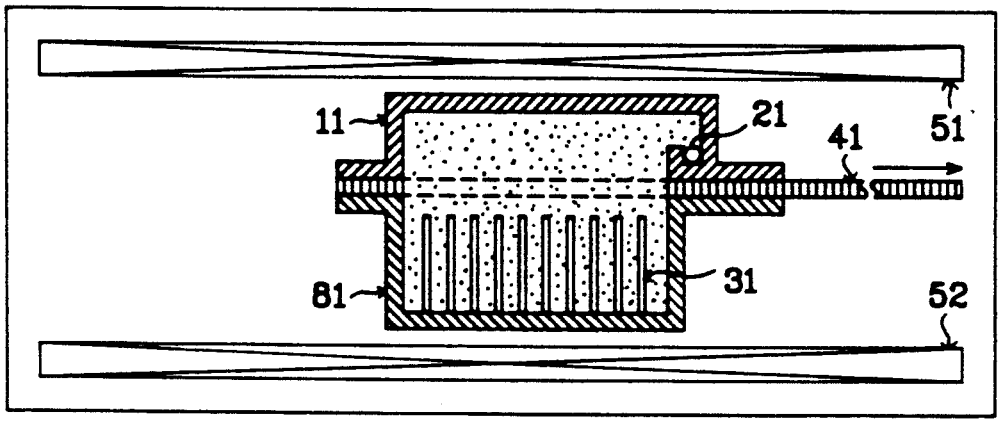
Figure 1C:
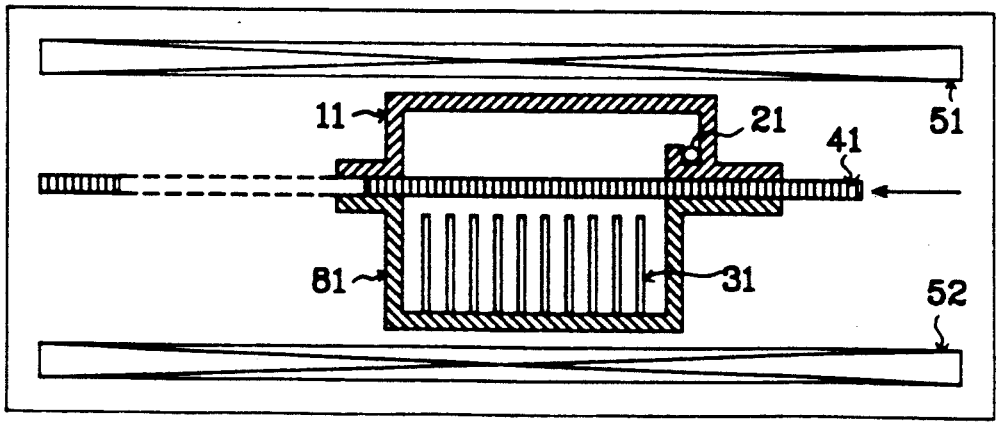

FIGS. 1A, 1B and 1C shows the open-tube type impurity diffusion apparatus according the present invention. The FIGS. 1A–1C embodiment of the present invention comprises a the diffusion box 11, a diffusion box 81, heaters 51 and 52, and a slider 41 including a perforated portion and a solid portion. As shown in FIGS. 1A–1C a plurality of wafers are serially loaded into the diffusion box 81 which may be made of the material as the diffusion box 11 of a conventional open tube-type impurity diffusion apparatus. Also, the slider 41 including the perforated portion and the solid portion is intervened between the diffusion box 11 and the diffusion box 81 for loading a plurality of wafers to employ as a shutter. Accordingly, the diffusion box 11 may communicate with the diffusion box 81 through the perforated portion of the slider 41 so that the impurities move from the diffusion box 11 to the diffusion box 81 through the perforated portion of the slider 41. The operation of the embodiment of the invention shown in FIGS. 1A–1C is as follows: In FIG. 1A, the slider 41 is interposed between the diffusion box 11 including the diffusion source 21 and the diffusion box 81 which receives and supports a plurality of wafers 31, to serve as a shutter. The slider 41 is operable to close-off communication between the boxes 11 and 81. The diffusion source 21 is received in the diffusion box 11 located on the slider 41. And the slider sets the temperature of the furnace is which the heaters 51 and 52 are received to a required diffusion temperature. After the required temperature setting, has been made the slider 41 is pushed in the direction indicated by the arrow to the position shown in FIG. 1B. Accordingly, the perforated portion of the slider 41 is put between the boxes 11 and 81 so that the diffusion box 11 communicates with the diffusion box 81 through the perforated portion of the slider 41. Therefore, the impurities of the diffusion source 21 activated by means of the heaters 51 and 52 move from the diffusion box 11 to the diffusion box 81 through perforated portion, and are diffused into the wafers 31.

Figure 2A:
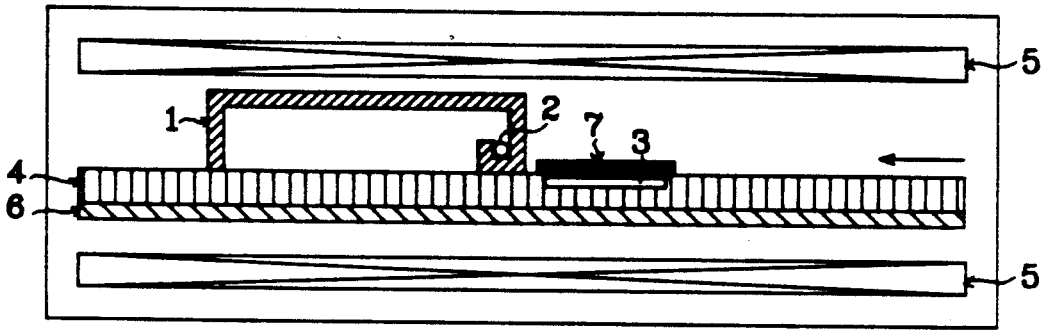
FIG. 2A (Prior art)
FIGS. 2A, 2B and 2C are is a sectional schematic views showing a conventional open tube-type impurity diffusion apparatus.
Figure 2B:
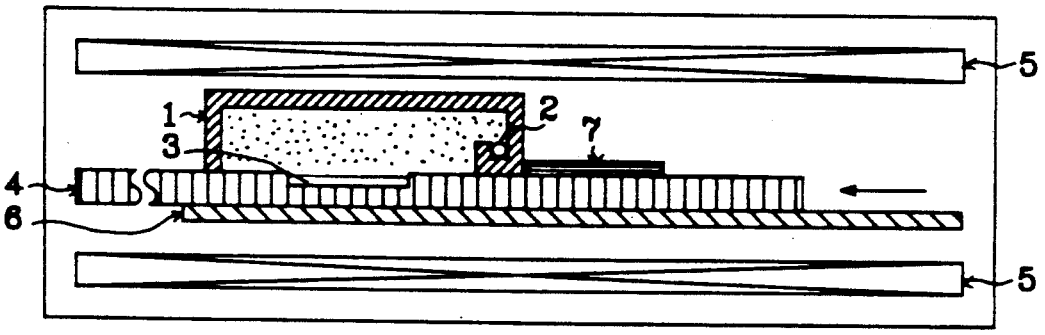
FIG. 2B (Prior art)
Figure 2C:
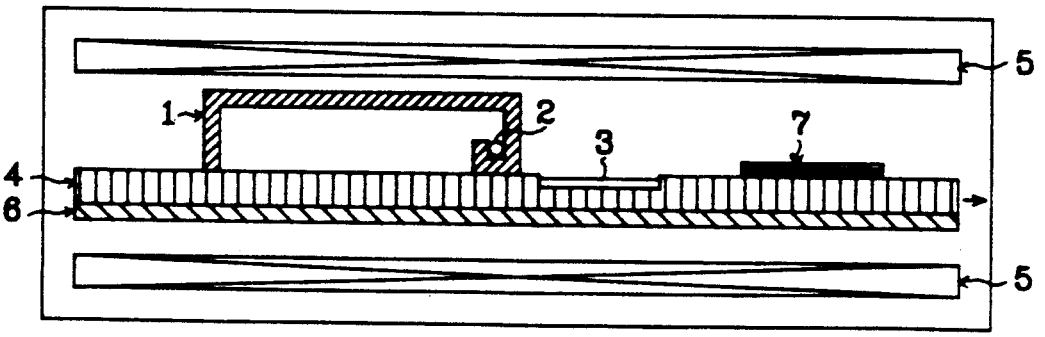
FIG. 2C (Prior art)

After the predetermined time, as shown in FIGS. 1C, the slider 41 which is employed as a shutter is pulled to return to the beginning point, so that the diffusion box 11 is separated from the diffusion box 81 again. Therefore, diffusion process is terminated. (FIGS. 2A-2C), which show a prior art apparatus, have already been described in the introductory part of this specification.)

Figure 3:
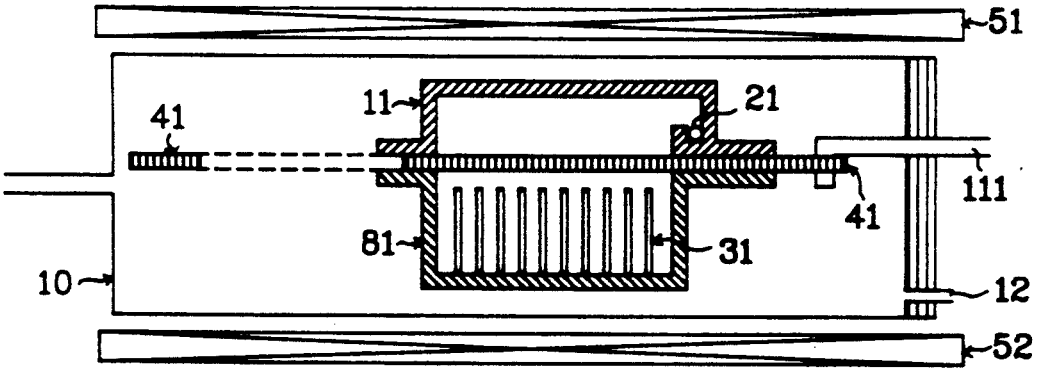
FIG. 3 is a sectional schematic view illustrating an embodiment of the present invention.

FIGS. 3 depicts a preferred embodiment of the apparatus of the invention. A unit comprising the diffusion box 11 which indicates the diffusion source 21, the diffusion box 81 which receives and supports a plurality of wafers 31, the slider 41 and a quartz bar 111, is stuffed into the furnace in which the heaters 51 and 52 and a quartz tube 10 are disposed. In this embodiment the diffusion box 11, the diffusion box 81 and the slider 41 are made of graphite or a material having same functionality in the context of the present invention. The temperature in the furnace is raised to the required diffusion temperature so that in a chamber of the unit there is produced a vacuum state. The diffusion process also can be performed under a vacuum state or in a gas environment caused by injecting either nitrogen gas or hydrogen gas through the gas; injection opening 12. In the preferred embodiment, if the wafers 31 are GaAs system wafers, ZnAs 2 is employed as the diffusion source. Also, if the wafers 31 are InP system wafers, $An_3P_2$ is employed as the diffusion source.

The slider 41 can be pulled and pushed passively or automatically by the quartz bar 111.

The perforated portion of the slider 41 is placed between the diffusion box 11 and the diffusion box 81, so that the diffusion process is performed.

Thereafter, the slider 41 is pulled in the direction of the arrow once more. Accordingly, the diffusion box 11 and the diffusion box 81 communicate with the quartz tube 10.

As in a chamber of the unit there is produced a vacuum state, the residual quantity of the impurities in the boxes 11 and 81 is exhausted through the quartz tube 10.

The slider 41 is pulled to return it to its beginning point.

The temperature in the furnace is lowered.

Therefore, the diffusion process is terminated.

Because the open tube-type impurity diffusion apparatus of the present invention can simultaneously diffusion of impurities into a plurality of wafers once, a mass of semiconductor wafers can be fabricated. Therefore, compared with the conventional apparatus, the production cost can be decreased. Also, because a plurality of wafers are diffused in a same environment, compared with an instance in which, as in the prior art, only one wafer at a time is subjected to the diffusion process, deviation of the wafer characteristics can be minimized.

The preferred embodiments described above are illustrative and not restrictive, the scope of the invention being indicated by the appended claims, and all variations which come within the meaning of the claims are intended to be embraced therein.

We claim:

1. An open tube-type impurity-diffusion apparatus for simultaneously diffusing impurities into a plurality of wafers subjected to a common environment, for producing a mass of semiconductor chips, said apparatus comprising:

a diffusion box arrangement including a first diffusion box having a first cavity with one open side and being otherwise closed and a second diffusion box having a second cavity with one open side and being otherwise closed; said open sides of said cavities of said first and second diffusion boxes spacedly confronting one another with a gap defined transversally between them;

a slider longitudinally slidingly received in said gap; said slider having an effectively perforated portion and an imperforate portion and being slidable between an open position in which said first and second cavities of said first and second boxes communicate with one another said effectively perforated portion of said slider, and a closed position in which said imperforate portion of said slider effectively closes off communication of said first cavity from said second cavity;

said first diffusion box having means disposed in said first cavity for providing when heated to a predetermined elevated temperature a source of impurities to be diffused into a plurality of wafers;

said second diffusion box having means disposed in said second cavity for supporting, with spacing from one another, a plurality of wafers into which impurities are to be diffused from said source of impurities; and heating means provided external to said cavities for elevating said temperature of said source of impurities to said predetermined elevated temperature so that said impurities can diffuse into said wafers while said predetermined temperature is maintained and a plurality of wafers are being supported with spacing from one another in said second cavity by said supporting means, said slider being in said open position thereof, and so that while said source of impurities is heating up to and cooling down from said predetermined elevated temperature said slider can be slid to said closed position thereof.

2. The apparatus of claim 1, wherein:

said diffusion box arrangement and said slider are housed within a tube pierced by a slidable rod which is engaged with said slider for sliding said slider between said open and said closed position thereof.

3. The apparatus of claim 1, wherein:

said heating means are disposed in a furnace and include heaters juxtaposed with both said first diffusion box and said second diffusion box, on opposite sides of said slider.

* * * * *